US006221160B1

(12) United States Patent
Lin

(10) Patent No.: US 6,221,160 B1
(45) Date of Patent: Apr. 24, 2001

(54) METHOD AND APPARATUS FOR ENVIRONMENTAL CONTROL IN A PROCESS CHAMBER

(75) Inventor: Yu-Liang Lin, Hsin-Chu (TW)

(73) Assignee: Taiwan Semiconductor Manufacturing Co., LTD, Hsin Chu (TW)

( * ) Notice: Subject to any disclaimer, the term of this patent is extended or adjusted under 35 U.S.C. 154(b) by 0 days.

(21) Appl. No.: 09/243,034

(22) Filed: Feb. 3, 1999

(51) Int. Cl.[7] ..... B05C 15/00

(52) U.S. Cl. ..... 118/326; 118/DIG. 7; 454/238; 454/239

(58) Field of Search ..... 118/708, 710, 118/712, 715, 663, 50, 52, 56, 319, 320, 326, DIG. 7; 454/238, 239; 137/115.25

(56) References Cited

U.S. PATENT DOCUMENTS 4,485,729 * 12/1984 Crittenden et al. ..... 454/238
5,095,811 * 3/1992 Shutic et al. ..... 118/326
5,312,297 * 5/1994 Dieckert et al. ..... 454/238
5,385,505 * 1/1995 Sharp et al. ..... 454/238
5,863,246 * 1/1999 Bujak et al. ..... 454/238

* cited by examiner

*Primary Examiner*—Laura Edwards
(74) *Attorney, Agent, or Firm*—Tung & Associates

(57) ABSTRACT

An apparatus and a method for environmental control in a process chamber, and specifically, in a spin coating chamber are disclosed. In the apparatus, an air velocity control system which consists of a pressure sensor, a throttle valve controller and a throttle valve is utilized for controlling the air velocity in a spin coating chamber, and specifically in a drain cup of a spin coating chamber. The present invention apparatus enables a novel method for reducing the air velocity in a spin chamber for achieving a more accurate process control, while maintaining a substantially constant humidity level in the process chamber. Frequently observed large fluctuations in the humidity and temperature in an air flow that is flown into the process chamber are thus minimized or eliminated. The present invention novel method and apparatus allows a spin coating process, and specifically a SOG spin coating process, to be carried out with improved accuracy and reliability.

8 Claims, 4 Drawing Sheets

| Pressure | Air Velocity | Valve Angle |
|---|---|---|
| 0.25 | 0.04 | 84 |
| 0.30 | 0.06 | 75 |
| 0.35 | 0.07 | 69 |
| 0.40 | 0.09 | 65 |
| 0.45 | 0.10 | 61 |
| 0.50 | 0.11 | 57 |
| 0.55 | 0.12 | 52 |
| 0.60 | 0.13 | 48 |
| 0.65 | 0.14 | 47 |
| 0.70 | 0.15 | 44 |
| 0.75 | 0.17 | 30 |
| 0.80 | 0.18 | 25 |
| 0.85 | 0.19 | 21 |

METHOD AND APPARATUS FOR ENVIRONMENTAL CONTROL IN A PROCESS CHAMBER

FIELD OF THE INVENTION

The present invention generally relates to a method and an apparatus for controlling the environment in a process chamber and more particularly, relates to a method and an apparatus for controlling the air velocity flown into a spin coating chamber by utilizing a throttle valve control system.

BACKGROUND OF THE INVENTION

Spin-on-glass (SOG) is frequently used for gap fill and planarization of inter-level dielectrics (ILD) in multi-level metalization structures. It is a desirable material for low-cost fabrication of IC circuits. Commonly used SOG materials may be of two basic types, i.e., an inorganic type silicate based SOG and an organic type siloxane based SOG. One of the typical organic type SOG materials is a silicon oxide based polysiloxane which is featured with radical groups replacing or attaching to oxygen atoms. Based on the two basic structures, the molecular weight, the viscosity and other desirable film properties of SOG can be modified and adjusted to suit the requirement of a specific IC fabrication process.

SOG film is typically applied to a pre-deposited oxide surface as a liquid to fill gaps and steps on the substrate. Similar to the application method for photoresist films, a SOG material can be dispensed onto a wafer and spun at a rotational speed which determines the thickness of the layer. After the film is evenly applied to the surface of the substrate, it is cured at a temperature of approximately 400° C. and then etched back to achieve a smooth surface in preparation for a capping oxide layer onto which a second inter-level metal may be patterned. The purpose of the etch-back step is to leave SOG between metal lines but not on top of the metal, while the capping oxide layer is used to seal and protect SOG during further fabrication processes. The siloxane based SOG material is capable of filling 0.15 micron gaps and therefore it can be used in 0.25 micron technology.

When fully cured, silicate SOG has similar properties like those of silicon dioxide. Silicate SOG does not absorb water in significant quantity and is thermally stable. However, one disadvantage of silicate SOG is the large volume shrinkage during curing. As a result, the silicate SOG retains high stress and cracks easily during curing and further handling. The cracking of the SOG layer can cause a serious contamination problem for the fabrication process. The problem can sometimes be avoided by the application of only a thin layer, i.e., 1000~2000 Å of the silicate SOG material.

A typical process which utilizes SOG material as an inter-metal dielectric (IMD) insulation is shown in FIG. 1A. A semiconductor structure 10 which has metal conductors 12 formed on a pre-processed semi-conducting substrate and an oxide layer 16 deposited on top is shown. The oxide layer may be suitably deposited of a boro-phospho-tetraethoxy-silicate (BPTEOS) material which is used to insulate previously deposited metal layers. The metal conductors 12 are formed by first depositing a metal layer on a diffusion barrier layer (not shown) such as TiN before the deposition of an AlCu material. On top of the metal conductor material, an adhesion promoter layer such as Ti or TiN is then deposited before an oxide cap layer 20 is used to insulate the metal conductors 12. The oxide cap layer 20 may be deposited of a plasma enhanced oxide (PEOX). On top of the semiconductor structure 10, a first SOG layer 22 is then deposited to seal the metal conductors 12 therein. Since SOG material has a large volume shrinkage ratio when it is deposited in a liquid form, the deposition step of SOG frequently results in void formations 18 and dips 24 in its top surface 14. The void formation may also be a serious problem when multi-layered metal structures in which uniform etching profiles are difficult to maintain are used. Voids in an inter-metal dielectric layer not only pose a reliability concern, i.e., for trapping chemicals or contaminents in the void, but also cause breaks in metal lines if a void is etch opened during a subsequent planarization process. This is shown in FIG. 1B. The open void 26 forms a crack in the SOG layer 22 and may cause a break in the metal lines 12. The void formation defects are especially serious when SOG layers are deposited into metal spacings of less than 0.5 $\mu$m.

The task of depositing IMD without void formations has been attempted by others in processes that are not 100% conformal. A complicated multi-step process using ion bombardment to round off comers in order to enhance the IMD filling capability has been developed. For instance, when a single deposition process for SOG results in void formation, as shown in FIG. 2A wherein void 32 is formed in the IC structure 30, the voids 32 can be minimized or eliminated by depositing the SOG film in several steps and sputter-etching between the steps. The multi-step process, also known as a "dep-etch-dep" process, alternately deposits and etches the IMD to create a desired profile. As shown in FIG. 2B, sputter-etching facets the SOG over vertical metal lines 34 and thus improving the gap-fill in a subsequent deposition step shown in FIG. 2C in which a second SOG layer 38 is deposited. The "dep-etch-dep" process, even though results in a substantially void-free SOG layer, requires complicated processing steps which increases the fabrication costs.

Referring now to FIG. 3, wherein a conventional set up for a spin coating apparatus 40 in a factory environment is shown. An air processor, or an air conditioner 68 is normally positioned on a lower floor away from the spin coating apparatus 40 to avoid vibration and contamination by the lubricants used in the air conditioner. An air conditioned flow of air 76 is transported to the spin coater 40 through air flow conduit 72. A damper control valve 80 is normally utilized to control the air flow 76. An enlarged, cross-sectional view of the spin coater 40 is shown in FIG. 4. Spin coater 40 is typically used for spin coating a SOG material on a wafer surface. As shown, in the apparatus 40, a cover 42, two side wall panels 44, 46 and a bottom panel 48 forms a sealed chamber containing a cavity 50 therein. The cover 42 also functions as an air duct for connecting to the flow inlet 52. The flow inlet is normally connected to the air duct through a damper control valve 80. An air flow 56 enters inlet 52, through the damper control valve 80 and other internal passageways (not shown) to enter the chamber cavity 50 as air flow 58. The air flow 56 which is fed into the air duct 42 can be advantageously taken from an air conditioning unit such that the relative humidity and the temperature of the incoming air 56 may be controlled. In the chamber cavity 50, wafer pedestal 62 is mounted on a rotatable shaft 64 and is rotated by DC motor 66. After a wafer 70 is positioned on the wafer pedestal 62 and securely mounted by vacuum means (not shown), a liquid dispensing nozzle is lowered to nearly touching the top surface of the wafer 70 at the wafer center. The distance between the nozzle head and the top surface of wafer 70 is between about 0.5 cm and about 3 cm. After wafer 70 is spun at a rotational speed of at least 100 RPM, or preferably at least 500 RPM, a SOG liquid is injected by a dispensing nozzle onto the center of the wafer. The material is spun out to cover the entire surface of the wafer 70. A drain collecting device 74, or a drain cup is used to collect excess liquid coating spun off the wafer surface 70. Excess liquid coating is then carried away by drain pipe 78. An outlet 82 is used to exhaust the air flow 58 such that the relative humidity in the chamber cavity 50 can be maintained.

In the conventional spin coating apparatus set-up, the air flow rate from an air processor, or an air conditioner is frequently too high to achieve an adequate control of a spin coating process. The only provision in the conventional set-up for correcting the air flow problem is to use a built-in damper control for reducing the air flow volume. For instance, when the air flow rate through the air processor is about 2 $m^3$/min, an air velocity in the drain cup of the spin coating device is about 0.28 m/s. When a damper control is used to reduce the air flow rate from the air processor, the variation in the air flow rate or the air velocity in the drain cup causes a large fluctuation in both the humidity and the temperature of the flow. It has been noticed that, when the damper control is used to control the flow rate, the humidity changes non-linearly with the air pressure. This results in a serious process control issue in that in an attempt to decrease the air flow rate, the humidity control is lost which causes variations in the properties of the coating layer obtained. It was further noted that in a conventional spin coating apparatus, the air velocity in the drain cup cannot be stabilized to carry out a reliable and repeatable process.

It is therefore an object of the present invention to provide a method for forming a spin-on-coating on an electronic substrate that does not have the drawbacks or shortcomings of the conventional methods.

It is another object of the present invention to provide a method for forming a spin-on-coating on an electronic substrate substantially without voids which does not require complicated process modifications.

It is a further object of the present invention to provide a method for forming a spin-on-coating on an electronic substrate substantially without void formation which does not require a multi-step deposition-etching-deposition process.

It is another further object of the present invention to provide a method for forming a spin-on-glass layer on a wafer that is substantially without void formation defects by incorporating a simple process modification.

It is still another object of the present invention to provide a method for forming a spin-on-glass layer on a wafer without the void formation defects by controlling the humidity content in the spin-coating chamber.

It is yet another object of the present invention to provide a method for forming a spin-on-glass layer on a wafer without the void formation defects by providing a substantially constant air flow in the spin-coating chamber.

It is still another further object of the present invention to provide an apparatus for spin-on-coating an electronic substrate substantially without void formation defects which is equipped with an air source for flowing into a spin-coating chamber an air flow of controlled humidity and flow rate.

It is yet another further object of the present invention to provide an apparatus for spin-on-coating an electronic substrate substantially without void formation defects which is equipped with an air velocity control system for flowing into the spin coating chamber an air flow of controlled humidity and reduced air velocity.

SUMMARY OF THE INVENTION

In accordance with the present invention, a method and apparatus for depositing a spin-on-glass coating layer on a semiconducting wafer substantially without void formation are provided.

In a preferred embodiment, an apparatus for controlling the environment in a process chamber can be provided which includes an air flow conduit which has an inlet, a first outlet and a second outlet, the inlet is in fluid communication with an air supply, the first outlet is in fluid communication with a cavity of the process chamber and the second outlet is in fluid communication with the atmosphere through a throttle valve, an air supply for feeding an air flow of controlled humidity and temperature into the inlet, a pressure sensor for detecting an air pressure in the first outlet and for sending a first signal to a throttle valve controller, a throttle valve controller for receiving the first signal from the pressure sensor to compare the signal to a pre-set pressure valve and to output a second signal to a driving means for driving the throttle valve, and a throttle valve for adjusting a volume of air flown into the atmosphere such that an air flow of controlled velocity enters the cavity in the process chamber through the first outlet.

In the apparatus for controlling the environment in a process chamber, the air supply may be an air conditioned flow of air which has controlled humidity and temperature. The pressure sensor may be further connected to a pressure read out and a process controller for the process chamber. The process chamber may be a spin coating chamber, such as a spin-on-glass coating chamber. The apparatus may open the throttle valve to increase the volume of air exhausted into the atmosphere so as to reduce the velocity of air flown into the cavity of the process chamber. The driving means for the throttle valve may be a motor.

The present invention is further directed to a method for controlling air velocity in a process chamber which can be carried out by the operating steps of first providing an air flow conduit which has an inlet, a first outlet and a second outlet, the inlet is in fluid communication with an air supply, the first outlet is in fluid communication with a cavity of the process chamber and the second outlet is in fluid communication with the atmosphere through a throttle valve, feeding an air flow of controlled humidity and temperature from the air supply into the inlet of the air flow conduit, detecting an air pressure in the first outlet by a pressure sensor and sending a first signal to a throttle valve controller, comparing the first signal to a pre-set pressure value stored in the throttle valve controller, and outputting a second signal to a drive means for changing the position of the throttle valve such that an air flow of controlled velocity enters into the cavity in the process chamber through the first outlet.

The method for controlling air velocity in a process chamber may further include the step of feeding an air flow of controlled humidity and temperature from an air conditioning unit. The method may further include the step of sending the first signal to a pressure read out and a process controller for the process chamber. The method may further include the step of providing a process chamber for a spin-on-coating process. The method may further include the step of providing a process chamber for a spin-on-glass or photoresist coating process. The method may still further include the step of opening the throttle valve to increase the air exhausted into the atmosphere through the second outlet so as to reduce the velocity of air flown into the cavity of the process chamber. The method may still further include the step of closing the throttle valve to decrease the air exhausted into the atmosphere through the second outlet so as to increase the velocity of air flow into the cavity of the process chamber.

In an alternate embodiment, a spin-on-glass coating chamber equipped with an air velocity control system is provided which includes a spin-on-glass coating chamber that has a cavity therein, an air flow conduit which has an inlet, a first outlet and a second outlet, the inlet is in fluid communication with an air supply, the first outlet is in fluid communication with a cavity of the process chamber and the second outlet is in fluid communication with the atmosphere through a throttle valve, an air processor for feeding an air flow of controlled humidity and temperature into the inlet, a pressure sensor for detecting an air pressure in the first outlet and for sending a first signal to a throttle valve controller, a throttle valve controller for receiving the first signal from the pressure sensor to compare the signal to a pre-set pressure value and to output a second signal to a drive means for adjusting the throttle valve, and a throttle valve for adjusting a volume of air flown into the atmosphere such that an air flow of controlled velocity enters the cavity in the spin-on-glass coating chamber through the first outlet.

In the spin-on-glass coating chamber equipped with an air velocity control system, the drive means for the throttle valve may be a motor. The air velocity control system opens the throttle valve to increase the volume of air exhausted into the atmosphere so as to reduce the velocity of air flown into the cavity of the coating chamber. The air velocity control system closes the throttle valve to decrease the volume of air exhausted into the atmosphere so as to increase the velocity of air flown into the cavity of the coating chamber. The air processor may be an air conditioning unit. The coating chamber may further include a pressure read out and a process controller for the coating chamber.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a method and apparatus for environmental control in a process chamber, and more specifically, discloses a method and apparatus for controlling the air flow speed in a spin coating apparatus such that a more reliable and repeatable process can be achieved.

In the apparatus for controlling the environment in a spin coating chamber, an air flow conduit is first provided which has an inlet, a first outlet and a second outlet. The air flow inlet is connected to an air supply, such as an air processor or an air conditioner. The first outlet for the air flow is connected to the cavity of the spin coating chamber. The second outlet for the air flow is connected to the atmosphere through a throttle valve. An air flow of controlled humidity and temperature is supplied by the air processor into the inlet of the air flow conduit. The novel air velocity control system of the present invention which is built into the spin coating chamber includes a pressure sensor, a throttle valve controller and a throttle valve. The pressure sensor is used for detecting the air pressure in the first conduit and for sending a first signal to the throttle valve controller which then compare the first signal with a preset pressure value and outputting a second signal to a drive means for adjusting the throttle valve. When the throttle valve positioned is subsequently adjusted to allow a smaller or a larger volume of air to flow into the atmosphere, the air velocity of the volume of air flown into the cavity in the spin coating chamber is thus regulated by the air flow bypassed and released to the atmosphere.

In carrying out the present invention novel method, the air pressure in the first conduit is first detected by the pressure sensor for sending out a first signal to a throttle valve controller, or optionally, sending to a pressure readout and a central process controller for the process chamber. The throttle valve controller then compares the first signal to a stored, preset value and then, outputting a second signal to a drive means, such as a motor, for changing deposition of the throttle valve such that an air flow of controlled velocity may enter the cavity in the process chamber through the first outlet.

Figure 1A:
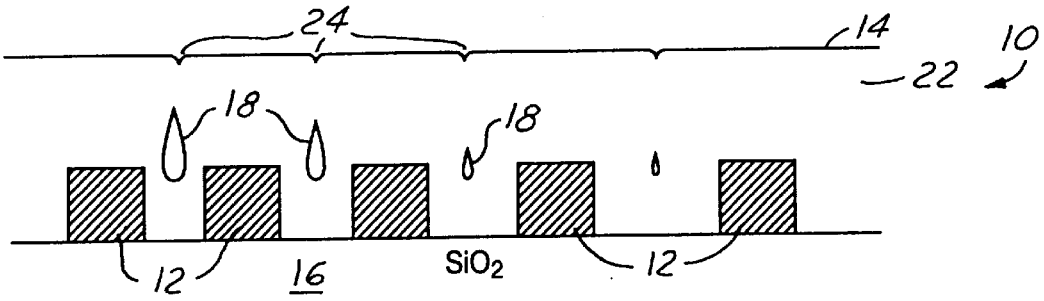
(PRIOR ART) FIG. 1A
FIG. 1A is an enlarged, cross-sectional view of a conventional IC structure which has metal conductors formed on an oxide layer and embedded in a spin-on-glass coating with void formation in the SOG layer.
Figure 1B:
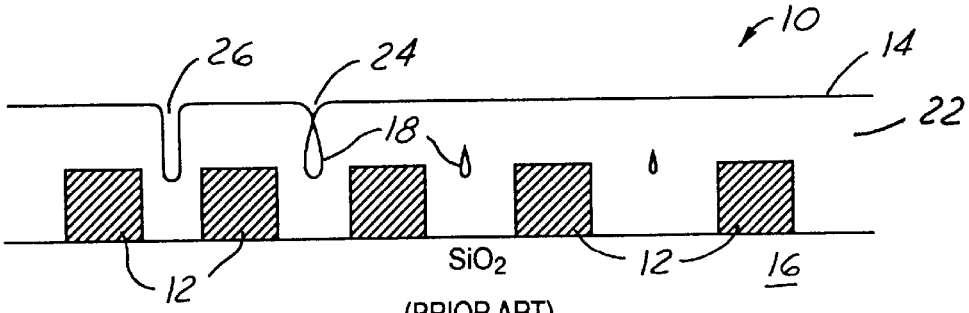
(PRIOR ART) FIG. 1B
FIG. 1B is an enlarged, cross-sectional view of the IC structure of FIG. 1A after a planarization etching process which opens some of the voids into crack openings.
Figure 2A:
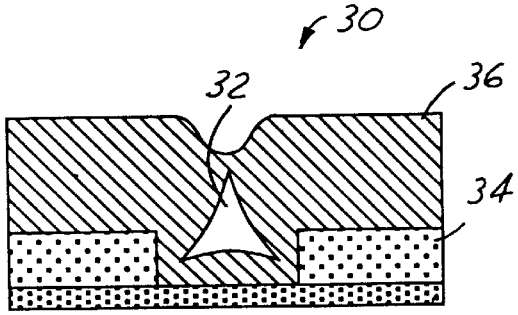
FIG. 2A is an enlarged, cross-sectional view of a conventional IC structure which has a void formation in a spin-on-glass coating layer between two metal conductors.
Figure 2B:
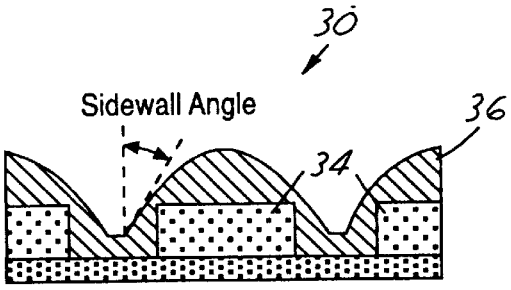
FIG. 2B is an enlarged, cross-sectional view of the IC structure of FIG. 2A after an etching step is carried out in a dep-etch-dep multi-step process.
Figure 2C:
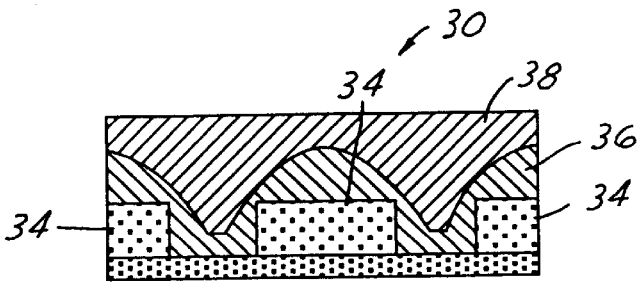
(PRIOR ART) FIG. 2C
FIG. 2C is an enlarged, cross-sectional view of the IC structure of FIG. 2B after a second SOG layer is deposited on top of the first SOG layer.
Figure 3:
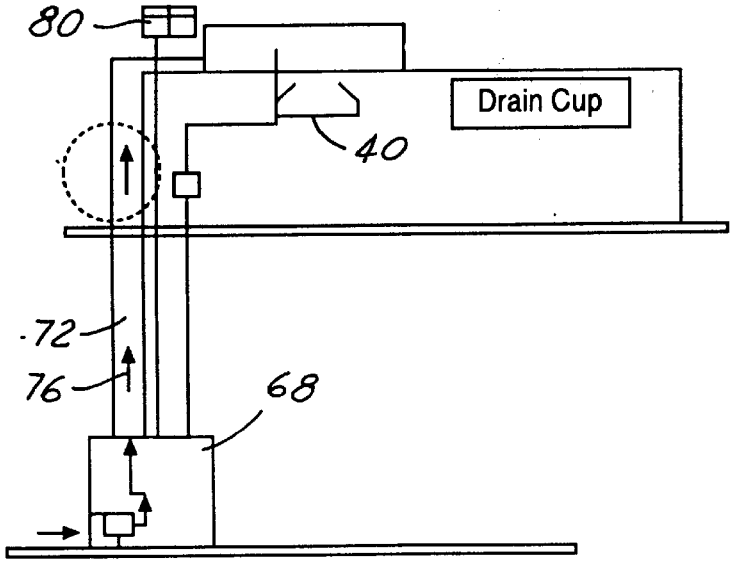
(PRIOR ART) FIG.3
FIG. 3 is an illustration of a conventional set-up of a spin coating apparatus with an air conditioning unit positioned on a lower floor.
Figure 4:
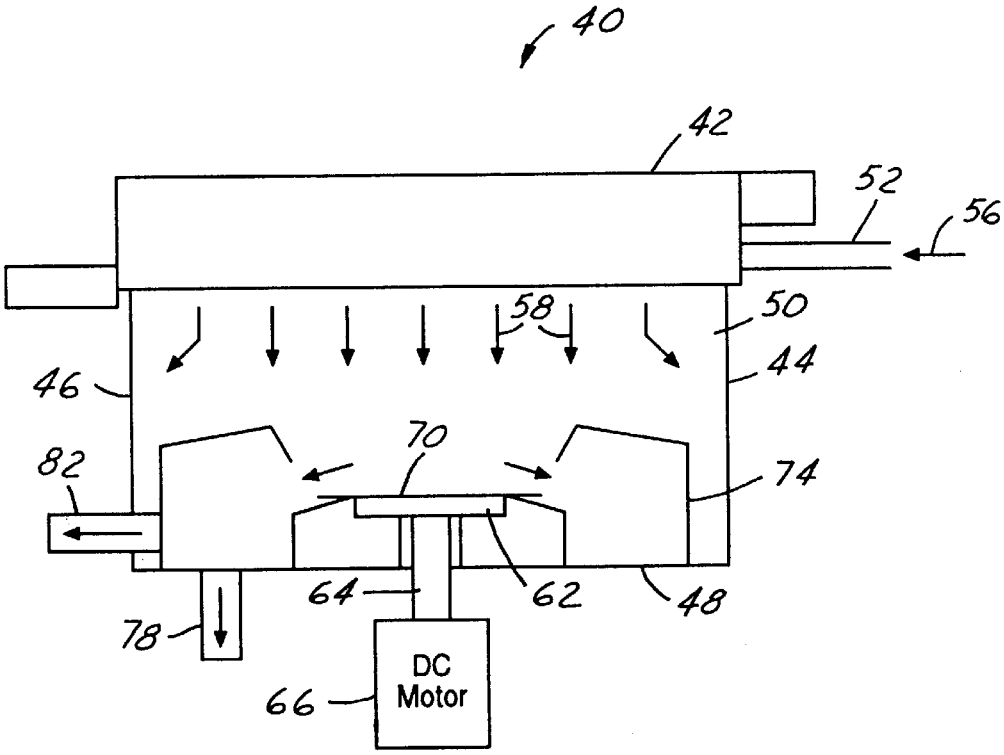
(PRIOR ART) FIG.4
FIG. 4 is a schematic of a conventional spin coating apparatus which is being fed by a damper controlled air processor.
Figure 5:
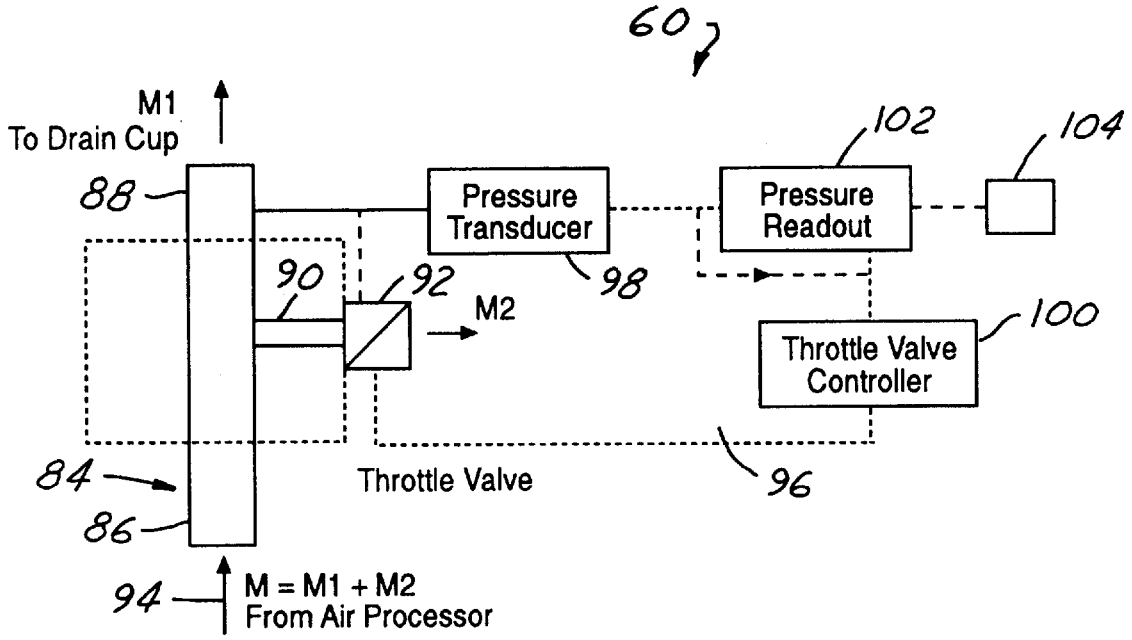
FIG. 5 is a schematic of a present invention air velocity control system equipped with a pressure transducer, a throttle valve controller and a throttle valve for controlling on air flow released to the atmosphere.

Referring now to FIG. 5, wherein a present invention apparatus for controlling the environment in a process chamber is shown. In the apparatus 60, an air flow conduit 84 is first provided which includes an air inlet 86, a first air outlet 88 to a cavity of a spin coating apparatus and a second air outlet 90 equipped with a throttle valve 92 for releasing air to the atmosphere. The air inlet 86 is in fluid communication with an air supply 94 from an air processor (not shown) or an air conditioner. The total volume of air from the air processor is M which is equal to M1+M2, with M1 being the volume of air flown to the cavity of the spin coater and M2 being the volume of air released to the atmosphere. It is evident that by increasing M2, M1 can be decreased since the total air volume M is constant.

The apparatus 60 which includes the present invention novel air velocity control system 96 is enclosed in the dashed lines in FIG. 5. The air velocity control system 96 further includes a pressure transducer 98, or a pressure sensor, a throttle valve controller 100 and a throttle valve 92. The air velocity control system 96 may optionally include a pressure readout 102 and a process controller 104 for the process chamber.

In operation, the pressure sensor 98 detects the air pressure in the first air outlet 88 and sends out a first signal to the throttle valve controller 100. The throttle valve controller 100 receives the first signal and compares it with a stored, predetermined pressure value (i.e., a desired value of air pressure) and then sends out a second signal to a drive means (not shown) for the throttle valve 92. The drive means, based on the second signal received, either opens or closes the throttle valve 92 to increase or decrease the air flow (M2) released to the atmosphere. When the drive means opens the throttle valve 92 to increase the volume of air exhausted into the atmosphere, the velocity of the air flow (M1) flown into the cavity of the process chamber is reduced correspondingly by the same amount that M2 was increased. Inversely, when the throttle valve 92 is closed to decrease the volume of air (M2) exhausted into the atmosphere, the velocity of the air flow (M1) flown into the cavity of the process chamber is increased.

Figure 6:
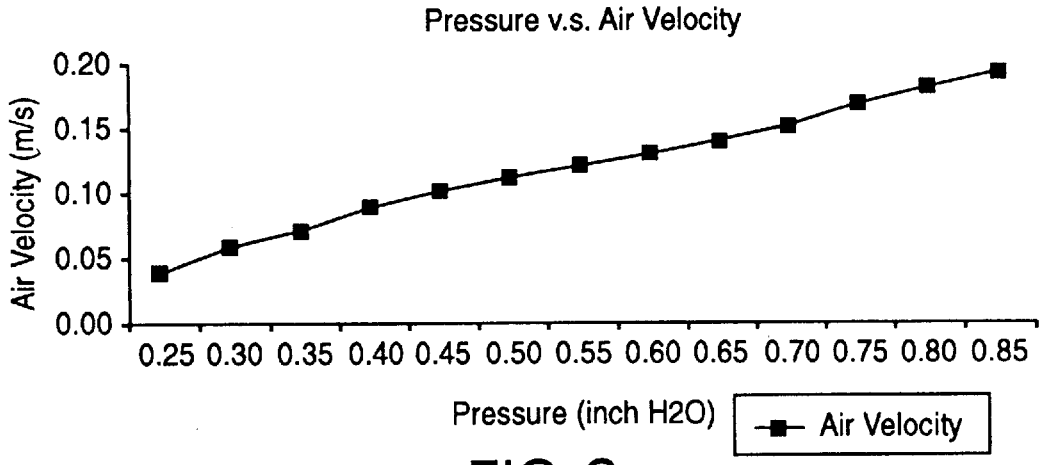
FIG. 6 is a graph illustrating a linear relationship between the air velocity and the air pressure released into a spin coating chamber used in the present invention apparatus.
Figures 7, 8:
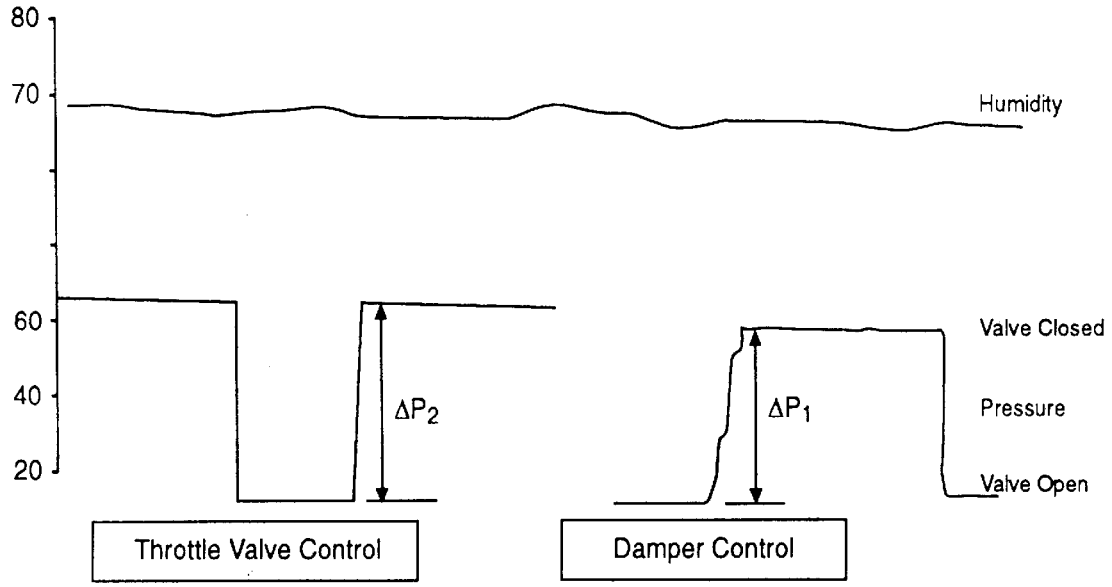
FIG. 7 is a table illustrating the numerical relationships between the air pressure, the air velocity and the throttle valve angle of the present invention apparatus of FIG. 5.
FIG. 8 is a graph illustrating the humidity variation due to the air pressure variation in a spin coating chamber in the present invention apparatus when compared to a conventional apparatus.

It has been found that in the present invention novel method, the changes in the air pressure follows a linear relationship with the changes in the air velocity. This is shown in FIGS. 6 and 7. It is noted that when the process specification for the present invention method is set at 0.08±0.05 m/s of air velocity, or when the process specification is set in the range of 0.04~0.16 m/s, a linear relationship between the air pressure measured by the pressure sensor and the air velocity change is linear and corresponds to a specific valve open angle. This is shown in FIG. 7. At the valve open angle of 84°, the throttle valve is almost completely shut off. Conversely, at a valve open angle of 21°, the throttle valve is completely opened.

It was also found in the present invention novel method, based experimental results obtained on 0.3 SRAM SOG process, the relative humidity obtained in the present invention apparatus is about 36±3, this is compared favorably in a narrower range to that obtained in a conventional apparatus of 40±4. Furthermore, the air flow velocity (m/s) for the present invention apparatus is in the range of 0.04~0.16, which compares favorably with that obtained in a conventional apparatus of 0.28±0.07. The present invention novel apparatus therefore allows the achievement of a lower air flow velocity in a spin coating chamber (or in the drain cup) of a spin coating chamber than that possible in the conventional apparatus. A stabilized humidity control made possible by the present invention novel apparatus is further shown in FIG. 8.

As shown in FIG. 8, the humidity control achieved by the present invention apparatus is shown in the left side of the figure under the heading of "throttle valve control", which is compared favorably to the humidity control achieved in a conventional apparatus marked as "damper control". It is seen that in the present invention apparatus, which incorporates an air velocity control system, a larger pressure change ($\Delta P2$) is obtained between the "valve closed" and "valve open" positions. This is compared favorably to a smaller pressure change of $\Delta P1$ obtained in the conventional apparatus. Even with the larger pressure variation, the humidity curve (shown on top of FIG. 8) remains substantially constant in the present invention apparatus as compared to that achieved in the conventional apparatus. By utilizing the present invention air velocity control system, the air velocity in the process chamber can be reduced without causing the frequently observed fluctuations in humidity control.

The present invention novel method and apparatus have therefore been amply demonstrated in the above descriptions and in the appended drawings of FIGS. 5~8. While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. An apparatus for controlling the environment in a process chamber comprising:

an air flow conduit having an inlet, a first outlet and a second outlet, said inlet in fluid communication with an air supply, said first outlet in fluid communication with a cavity of said process chamber and said second outlet in fluid communication with the atmosphere through a throttle valve, an air supply for feeding an air flow of controlled humidity and temperature into said inlet, a pressure sensor for detecting an air pressure in said first outlet and for sending a first signal to a throttle valve controller, a throttle valve controller for receiving said first signal from said pressure sensor to compare said signal to a pre-set pressure value, and to output a second signal to a drive means for adjusting said throttle valve, and a throttle valve for adjusting a volume of air flown into the atmosphere such that an air flow of controlled velocity enters said cavity in the process chamber through said first outlet.

2. An apparatus for controlling the environment in a process chamber according to claim 1, wherein said air supply is an air conditioned flow of air having controlled humidity and temperature.

3. An apparatus for controlling the environment in a process chamber according to claim 1, wherein said pressure sensor is further connected to a pressure readout.

4. An apparatus for controlling the environment in a process chamber according to claim 1 further comprising a driving means for said throttle valve.

5. A spin-on-glass chamber equipped with an air velocity control system comprising:

a spin-on-glass coating chamber having a cavity therein, an air flow conduit having an inlet, a first outlet and a second outlet, said inlet in fluid communication with an air supply, said first outlet in fluid communication with a cavity of said process chamber and said second outlet in fluid communication with the atmosphere through a throttle valve, an air processor for feeding an air flow of controlled humidity and temperature into said inlet, a pressure sensor for detecting an air pressure in said first outlet and for sending a first signal to a throttle valve controller, a throttle valve controller for receiving said first signal from said pressure sensor to compare said signal to a preset pressure value, and a throttle valve for adjusting a volume of air flown into the atmosphere such that an air flow of controlled velocity enters said cavity in said spin-on-glass coating chamber through said first outlet.

6. A spin-on-glass coating chamber equipped with an air velocity control system according to claim 5 further comprising a drive means for said throttle valve.

7. A spin-on-glass coating chamber equipped with an air velocity control system according to claim 5, wherein said air processor is an air conditioning unit.

8. A spin-on-glass coating chamber equipped with an air velocity control system according to claim 5 further comprising a pressure readout and a process controller for the coating chamber.

* * * * *